United States Patent [19]

Graf

[11] Patent Number: 5,076,507

[45] Date of Patent: Dec. 31, 1991

[54] VARIABLE DENSITY GRINDING MEDIA

[75] Inventor: Carl R. Graf, King of Prussia, Pa.

[73] Assignee: Pennsylvania Crusher Corporation, Broomall, Pa.

[21] Appl. No.: 452,825

[22] Filed: Dec. 21, 1989

Related U.S. Application Data

[63] Continuation of Ser. No. 201,925, Jun. 3, 1988, abandoned, which is a continuation-in-part of Ser. No. 28,435, Mar. 20, 1987, abandoned.

[51] Int. Cl.[5] ..... B02C 17/20

[52] U.S. Cl. ..... 241/184

[58] Field of Search ..... 241/184, 176, 177, 178, 241/170, 137, 153, 72, 179

[56] References Cited

U.S. PATENT DOCUMENTS 1,398,970 12/1921 Leddell ..... 241/184

FOREIGN PATENT DOCUMENTS 345915 12/1921 Fed. Rep. of Germany ..... 241/184

738347 8/1943 Fed. Rep. of Germany ..... 241/184

22059 of 1913 United Kingdom ..... 241/184

OTHER PUBLICATIONS

Foster Wheeler Publication, 5-1989.

*Primary Examiner*—Mark Rosenbaum

*Attorney, Agent, or Firm*—Pollock, Vande Sande & Priddy

[57] ABSTRACT

A grinding mill having a rotatable grinding chamber within which is a body of elongate grinding members that have a longitudinal axis substantially longer than the maximum transverse dimension thereof. The mill is arranged in such a way as to retaining the grinding member axes substantially parallel to the grinding chamber rotational axis. The grinding members have a cross-sectional shape and a sufficient exterior surface smoothness for enabling a body of such members to tumble over and against one another in a rotating grinding chamber and to grind particulate material within the body, as well as a ratio of mass per unit of length which varies from one position to another along the length of the longitudinal axis.

11 Claims, 4 Drawing Sheets

ROD

PIPE

VARIABLE DENSITY ROLL

VARIABLE DENSITY GRINDING MEDIA

CROSS-REFERENCE TO RELATED APPLICATION

This is a continuation of copending application Ser. No. 201,925, filed on Jun. 3, 1988, now abandoned, which was a continuation in part of copending application Ser. No. 028,435, filed Mar. 20, 1987, now abandoned, the entire disclosures of which are hereby incorporated herein by reference.

BACKGROUND OF THE INVENTION

The use of solid rods and/or hollow pipes as grinding media has been common practice in varied industries for many years. For example, they have been used as grinding media in mills having enclosed grinding chambers which rotate about their longitudinal axes, generally at speeds less than critical speed. Typical units are illustrated in FIGS. 1 and 2.

The rods and pipes, when used in mills with cylindrical grinding chambers, form a kidney-shaped tumbling mass adjacent the up running side of the rotating cylinder when viewed from either end of the cylinder and, as the cylinder turns, the rods and pipes migrate and move rotationally through the mass and about their own axes, crushing and grinding the material to be reduced between the rolling or moving surfaces of the rods and pipes. These mills generally include means for retaining the rod and/or pipe axes substantially parallel to the grinding chamber rotational axis. This can for example be accomplished in a circular cylindrical grinding chamber by providing it with a length in excess of its diameter. For instance, a length to diameter ratio of at least about 1.2 or preferably at least about 1.3 will be sufficient to prevent the rods and pipes from standing on end and/or tangling with one another in most instances.

While pipes and rods both produce a limited number of fines in the ground product, rods generally produce a finer particle size distribution than pipes. Because pipes are less dense than rods, a pipe mill is typically of larger cross-section and length than a rod mill which draws the same amount of power. In the pipe mill the throughput is also larger, because the mill cross-section that the material traverses is larger than that in the above-mentioned rod mill. Continuing our comparison of these two mills of equal power draw, the pipe mill tends to produce a larger weight of product per unit time, but does less work on the material per unit of material weight, resulting in a larger particle size product than that produced by the rod mill.

Characteristics of the material being ground also play a role in how fine a product is produced, which role is at least in part independent of the density of the grinding medium and hence of the power to achieve the results. This is also reflected in the size distribution of the ground product. It is for example well known that when a material with flaws or grain structure boundaries is subjected to a compression or impact load, a large particle of the material will break more readily than a smaller particle.

It is believed that there is a need for a mill which can provide increased throughput capacity with smaller cross-section while minimizing excessive generation of fine particles. The primary object of this invention is to fulfill this need.

SUMMARY OF THE INVENTION

It is believed that the foregoing need has been met by the present invention, which includes elongate rod or tube grinding members, sets of such grinding members and tube or rod mills containing such members. Thus, the elongate rod or tube grinding member of the present invention is for grinding particulate material in an elongated, cylindrical grinding chamber of a tube or rod mill, the latter being rotatable about a longitudinal axis of the chamber. According to the invention, the rod or tube grinding member has not only a substantially uniform outside diameter throughout its length, but also a mass per unit length in one half of its length that substantially exceeds the mass per unit length of the other half of its length, for gradually varying the force applied to the material and the power draw in the chamber along the length thereof. Moreover, the grinding member has a sufficient exterior surface smoothness, a cross-sectional shape and a longitudinal axis substantially longer than the maximum transverse dimension of said member, for enabling said member to cooperate with other like members in forming a tumbling mass of such members adjacent the up-running side of said a chamber when it rotates, in which mass the grinding members will migrate and move rotationally through the mass and about their own axes.

The sets of elongate rod or tube grinding members contemplated by the invention are for use in tube or rod mills similar to those described above. These sets comprise rod or tube grinding members each being of circular cross-section and uniform diameter throughout its length. In other respects the grinding members have characteristics similar to those described above for enabling the members of such set to cooperate with one another in forming a tumbling mass of such members adjacent the up-running side of such a chamber when it rotates, in which mass the grinding members will migrate and move rotationally through the mass and about their own axes.

As indicated above, the present invention also includes a tube or rod mill for grinding particulate material. In common with prior mills of this type it comprises a rotatable, elongated grinding chamber of cylindrical, circular cross-section having first and second ends, a longitudinal axis and a length to diameter ratio of at least about 1.2. Also in common with prior practice the mill includes within its chamber a bed comprising elongate rod or tube grinding members. However, in accordance with the present invention, these members respectively have a mass per unit length in one half of their lengths which substantially exceeds the mass per unit length in the other half of their lengths, whereby the members have heavy ends and light ends, the heavy ends of the respective grinding members being disposed toward the same end of the chamber for gradually varying the force applied to the material and the power draw in the chamber along the length thereof. Also, the grinding members have longitudinal axes substantially longer than the maximum transverse dimensions of the grinding members and lengths which are smaller than the length of the chamber but sufficiently large for retaining the grinding member longitudinal axes substantially parallel to the grinding chamber axis. Finally, these members have a sufficient exterior surface smoothness, a cross-sectional shape and transverse dimensions which represent a small fraction of the transverse dimension of the chamber, for causing said members to cooperate in forming a tumbling mass of such members adjacent the up-running side of the chamber when it rotates and causing the mass of grinding members to migrate and move rotationally through the mass and about their own axes while said axes are held substantially parallel to the grinding chamber axis.

The invention includes various preferred embodiments applicable to the grinding members, grinding member sets and mills. For example, the heavy ends of the grinding members may be disposed to the discharge end or to the feed end of the grinding chamber. Also, the mass per unit length of the respective grinding member or members is preferably arranged so that it progressively and substantially increases at successive positions along the length thereof. In the alternative, density may increase in a similar manner. In either of the foregoing cases, the cross-section of the respective grinding member or members is preferably substantially uniform throughout the length thereof.

Another particularly preferred embodiment of the invention, applicable equally to the grinding members, to the sets thereof or to the mills utilizing same, includes a grinding member or members comprising a tube of substantially uniform mass per unit length. Such tube has first and second ends and includes a hollow enclosure extending longitudinally between those ends, with a weight being retained in the enclosure and held nearer one of the ends.

According to yet another preferred embodiment, also applicable to the members, sets and mills, the grinding member or members comprise a tube of substantially uniform mass per unit length, each having first and second ends and including a hollow enclosure extending longitudinally between those ends. A plurality of weights of varying mass fill the cross-section of the enclosure, are fixed in the enclosure and are distributed along its length for progressively increasing the ratio of mass per unit length of the grinding member from the first end to the second end.

The reduction in fines from use of the invention (which may for example be a reduction of 3% to 7% by weight in the minus 100 mesh size classification) may seem small. However, in processes intended to turn the blight of coal waste into a useful purpose, involving preparation of the waste for combustion in fluidized bed boilers, such reductions can be quite significant. The value of these small reductions in the fines content of the resultant fuel are magnified by the improvement in the efficiency of the process (boiler efficiency). When the invention is applied to the preparation of limestone for injection into such boilers, the resultant reduction in fines content can cause desulfurization to occur in the boilers where the reaction is intended rather than never entering that intended area or leaving it prematurely.

In other less dramatic and environmentally enhancing applications where fluidization is not involved, the contribution is lessened, but may still remain economically viable. Where fines can be lowered in these processes the cost of production, wear and power are lowered. Capital savings include not only the mill itself, but also in some instances elimination of additional ancillary equipment which is required to keep fines production in check.

Other advantages of the invention will become apparent to those skilled in the art from this disclosure and inherently as a result of their experience with the invention.

This invention may be embodied in a wide variety of ways, some of which are believed to be inventions in their own right and are illustrated in the accompanying drawings, description of preferred embodiments and claims.

DESCRIPTION OF PREFERRED EMBODIMENTS

Figure 1:
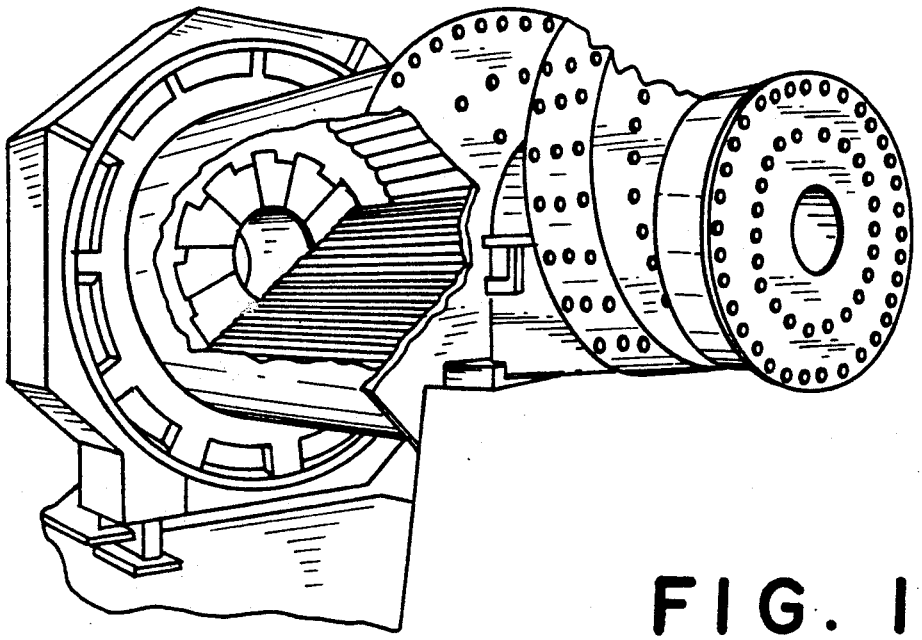
FIG. 1 (PRIOR ART)
FIG. 1 is a perspective view, with portions broken out, of a prior art overflow rod mill.
Figure 2:
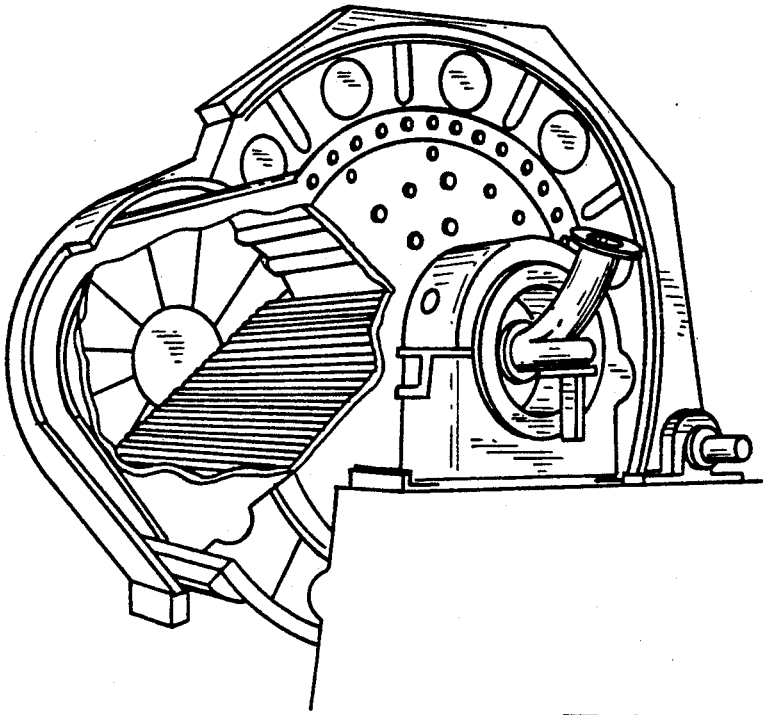
FIG. 2 (PRIOR ART)
FIG. 2 is a perspective view, with portions broken out, of a prior art end peripheral discharge rod mill.
Figure 3A:
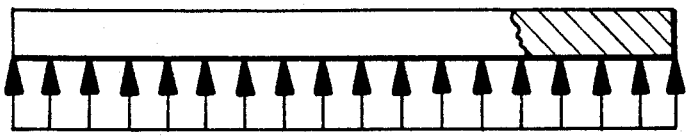
FIGS. 3A, 3B and 3C are a progression of schematic views representing the relative forces which are imposed on material being ground in a grinding mill by, respectively, rod, pipe and a variable density grinding member in accordance with the invention, at different positions along the length of such rod, pipe and member.
Figure 3B:
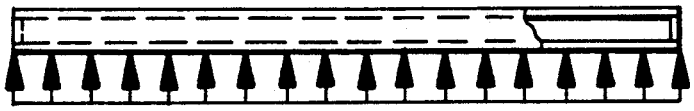
Figure 3C:
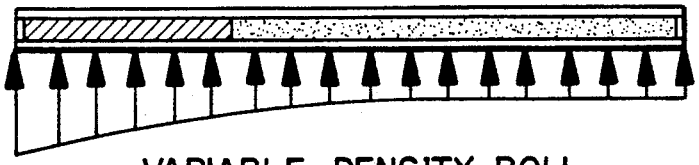

FIGS. 3A, 3B and 3C represent graphic illustrations of forces imposed by rod, pipe and a variable density roll (a pipe filled at one end with a dense material with the balance, for example filled with a light wood and epoxy mixture of the like). The forces imposed by the variable density roll vary over its length. When a multiplicity of these variable density rolls are placed in a rotating drum, rotating at a speed causing the rolls to ride up the side of the drum, rotating and tumbling in the process, variable work is done over the length of the drum.

Figure 4:
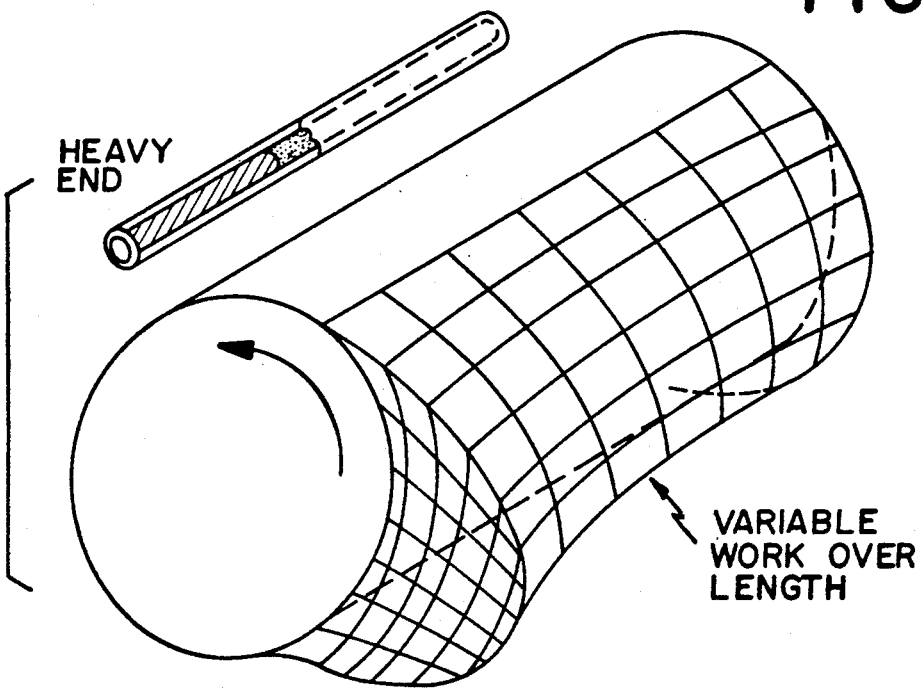
FIG. 4 is a schematic representation, in perspective, of a variable density grinding member in accordance with the invention and of the drum of a grinding mill containing a bed (not shown) of such members. A three-dimensional graph, in perspective, illustrating the variation in the amount of work performed on the material in the bed at varying locations along the length of the drum, is superimposed on the drum.

The parabolic volume graphically illustrated along the side of the drum in FIG. 4 shows the resultant variable work being done over the length of the cylinder by these variable density rolls. Comparing this graphic representation with FIG. 3C illustrates how a bed of tubes weighted at the discharge end of the mill, operating on a reasonably uniform feed to progressively reduce it, applies gradually increasing work to the material under treatment in the bed as grinding generates the new surfaces and a resulting increase in the work resistance of the material.

As indicated above, the invention can be embodied in a wide variety of ways. For example, the grinding member may be monolithic throughout its length, or may be fabricated from connected segments of similar or diverse materials. Different portions of the length may be metallic and/or non-metallic portions of: (a) similar wearing capacity but different mass per unit length; or (b) similar density but including voids of different size; or (c) similar external and internal dimensions but of differing density; or (d) combinations of the foregoing; or (e) other configurations.

Geometrically the grinding members preferably have a length to diameter ratio of about 7 to 1 or more with a maximum ratio limited only by the availability of suitable fabrication components with sufficient wall thickness to provide structural integrity in the intended application. The invention is not subject to the historical limitation on the use of rods exceeding twenty feet in length, since the grinding members of the invention can be fabricated from tubes, which are available in longer lengths as well as bigger diameters.

Figure 5:
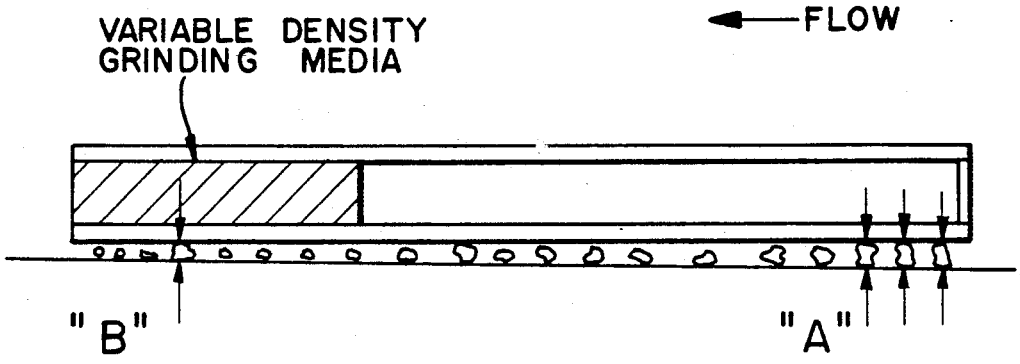
FIG. 5 is a schematic illustration in vertical cross-section of a variable density grinding tube in accordance with the invention, which includes a schematic representation of particles being ground beneath the grinding member.

FIG. 5 illustrates a grinding member in which one end of a pipe is filled with a high density material This causes one end of the grinding member to produce a product such as would be generated by solid rods, while the other end would act or produce a product such as would be generated by hollow pipes. Intermediate the ends, the action of the FIG. 5 grinding member operates in a transitional mode, i.e. in a manner between that of rods and pipes. Moreover, the foregoing can be accomplished in the same grinding chamber.

Figure 6:
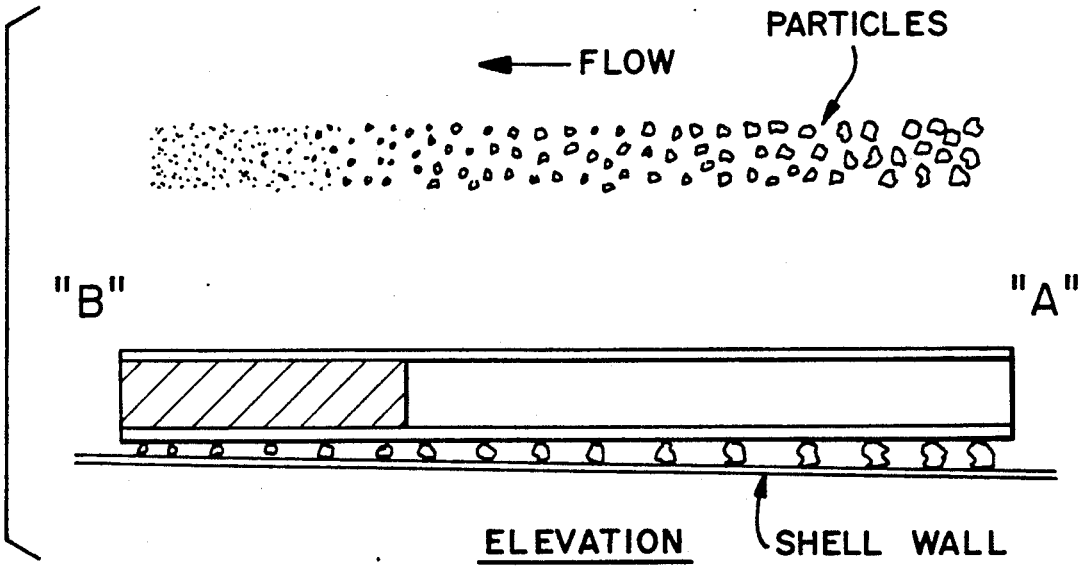
FIG. 6 is a schematic view in vertical cross-section of a variable density grinding member in accordance with the invention, above which is shown a schematic representation of the particles beneath the grinding member.

In addition to the grinding member, FIG. 5 schematically discloses particles being ground between the grinding member and the underlying wall of a grinding chamber. In this Figure the large feed particles at the feed end, indicated by capital A, produce fewer resisting points to the variable density grinding member at its lighter end, where the particles have the least surface area, causes a minimum amount of reduction with a minimum number of fine particles being generated. In the same Figure, at B, a harder particle among a cluster of smaller particles, such as may be encountered in heterogeneous materials, has traversed the length of the variable density grinding member and has gotten under the heavier end where it is more likely to be reduced. Here again a minimum number of fines will be produced since the force of the variable density grinding member has not abruptly become overwhelming, but rather acts on the material with ever increasing force (and therefore, increasing power draw per foot) until the size and number of particles present a resistance that slows down or eliminates further reduction. Thus, power consumption is related to the fineness and to the particle size distribution of the product, the least power being consumed at inlet end A and the most being consumed at outlet end B, FIG. 6 is a schematic view similar to FIG. 5 except that the upper portion of the Figure includes a plan view of the particles that are being ground between the variable density grinding member and the wall of the grinding chamber. As can be seen from FIG. 6 there are many more smaller particles at outlet end B than at inlet end A, thereby presenting more surface of resistance to the grinding member at the outlet end. The gradually increasing number of particles present as the particles approach the outlet end gradually slows down the rate of particle reduction and inhibits excessive reduction.

Figure 7:
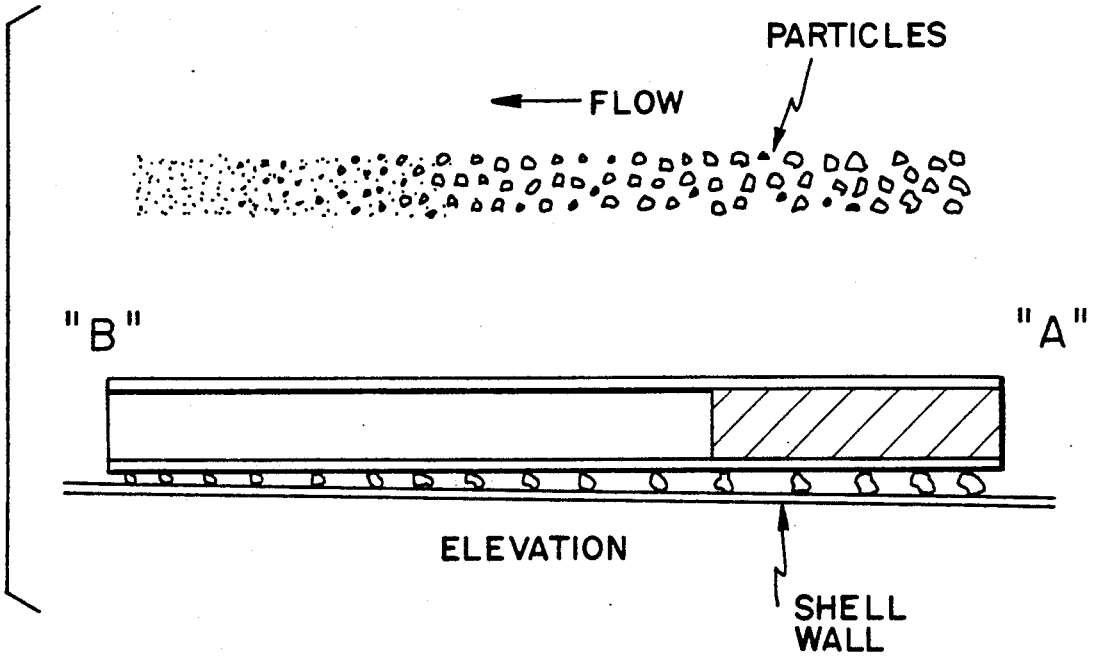
FIG. 7 is also a schematic view in vertical cross-section of a variable density grinding member in accordance with the invention, above which is shown a schematic representation of the particles beneath the grinding member. However, in this view the relationship between the directions of progression of the increase in the gravity of the grinding member and of the flow of material is the reverse of that shown in FIG. 4A.

The opposite mode of operation is illustrated in FIG. 7, which has for example been found useful when the constituents in the material being reduced are diverse in hardness, size or other characteristics bearing on grindability. In these instances better results can be obtained when the weighted roll is reversed end for end. This is primarily because the larger pieces in naturally occurring feed material are frequently also the hardest and must be brought down to size rapidly in order that the rolls not be kept apart for too great a part of their length, and be allowed to come together more quickly to apply increased work to the softer material in the lower work input area of the drum.

The variable density grinding members vary the horsepower consumed per foot of mill length. They concentrate the highest consumption in the area of the mill where the most work must be done to reduce the material to the desired particle size distribution, while inhibiting application of excess work and fostering a more controlled reduction. Power consumption is directly related to the characteristics of the feed and of the desired product, resulting in fewer fines or in a grinding environment where production of fines will be controlled. Since the work performed during each foot of chamber length is varied, the amount of reduction per foot is also varied and over-grinding in the mill can be controlled. Reduction of over-grinding and closer control over particle size distribution save on power and enable the design of the apparatus to be optimized with respect to the desired end product. Also, it should be possible to produce a tighter spectrum of sizes than would normally be expected from conventional pipe or rod mills.

Figure 8:
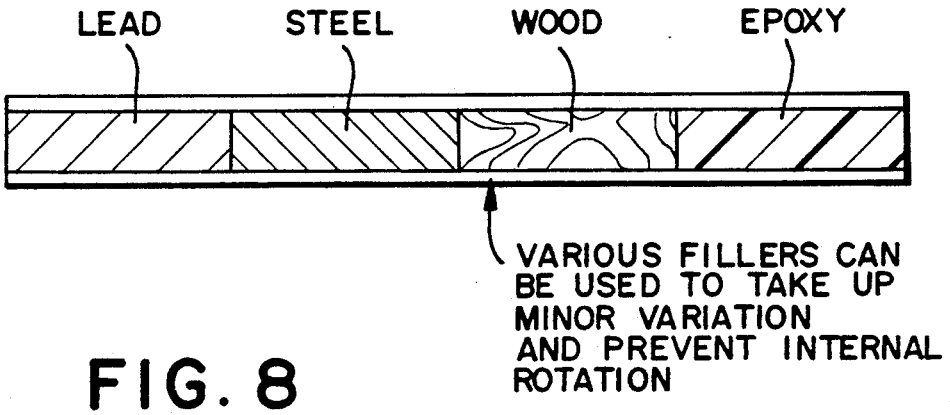
FIG. 8 is a schematic diagram in vertical cross-section of a variable density grinding member in accordance with the invention having a plurality of segments of differing density situated at various positions along its longitudinal axis.

As disclosed in FIG. 8, a plurality of fillers or weights can be used in the pipe, and various mechanical methods and fastening means, such as adhesives, can hold the weights in place. As disclosed in FIG. 8, the fills can vary, and according to one embodiment the fills are of progressively increasing density at successive positions along the length of the grinding member.

The most preferred embodiments of the grinding member are those disclosed in FIGS. 5, 6 and 8, described above.

An assortment of materials have been tested, including glass, ceramics, fine grained limestone, coarse grained limestone (with heavy calcite veining), coals of varying hardness, culm (anthracite waste) and gob (soft coal waste).

Fine grained feeds which occur in nature and are heterogeneous are most favorably reduced as shown in FIGS. 3C, 4, 5, and 6, i.e. the weighted end of the roll is at the discharge end of the mill. Materials which also occur in nature as heterogeneous, but with wide divergence in hardness, grain size and feed size yield the best results when the weighted end is placed at the feed end as shown in FIG. 7. In the experiences had with the invention thusfar, the least benefits are obtained when operating upon materials altered by man to a homogeneous or near homogeneous material of approximately the same feed size.

The amount of weight utilized in the grinding member and the most efficient amount of offset of the center of gravity of the member are related to the material characteristics, and persons skilled in the art, having the benefit of this disclosure will readily determine same without undue experimentation by specific tests on a case by case basis. Generally, for many naturally occurring materials, including those set forth above, it appears that the benefits derived from using the disclosed grinding members diminishes rapidly when the center of gravity along the long axis is offset by less than about 7% and more particularly about 10% (based on the total length of the grinding member), and when the offset exceeds about 40% and more particularly about 30% from the mid point.

What is claimed is:

1. An elongate rod or tube grinding member for grinding particulate material in an elongated, cylindrical grinding chamber of a tube or rod mill rotatable about a longitudinal axis of said chamber, said rod or tube grinding member having:

(A) a substantially uniform outside diameter throughout its length;

(B) a mass per unit length in one half of its length which substantially exceeds the mass per unit length of the other half of its length, for gradually varying the force applied to the material and the power draw in the chamber along the length thereof; and (C) a sufficient exterior surface smoothness, a cross-sectional shape and a longitudinal axis substantially longer than the maximum transverse direction of said member, for enabling said member to cooperate with other like members in forming a tumbling mass of such members adjacent the up-running side of such a chamber when it rotates, in which mass the grinding members will migrate and move rotationally through the mass and about their own axes.

2. A set of elongate rod or tube grinding members for grinding particulate material in an elongated, cylindrical grinding chamber of a tube or rod mill rotatable about a longitudinal axis of said chamber, comprising rod or tube grinding members each:

(A) being of circular cross-section and substantially uniform outside diameter throughout its length; and (B) having:

(1) a mass per unit length in one half of its length which substantially exceeds the mass per unit length of the other half of its length for gradually varying the force applied to the material and the power draw in the chamber along the length thereof; and a sufficient exterior surface smoothness, a cross-sectional shape and a longitudinal axis substantially longer than the maximum transverse dimension of said member, for enabling the members of such set to cooperate with one another in forming a tumbling mass of such members adjacent the up-running side of such a chamber when it rotates, in which mass the grinding members will migrate and move rotationally through the mass and about their own axes.

3. A tube or rod mill for grinding particulate material, comprising:

(A) a rotatable, elongated grinding chamber of cylindrical, circular cross-section having first and second ends, a longitudinal axis and a length to diameter ratio of at least about 1.2, and (B) within said chamber a bed comprising elongate rod or tube grinding members which respectively have:

(1) a mass per unit length in one half of their lengths which substantially exceeds the mass per unit length in the other half of their lengths, whereby the members have heavy ends and light ends, the heavy ends of the respective grinding members being disposed toward the same end of the chamber for gradually varying the force applied to the material and the power draw in the chamber along the length thereof;

(2) grinding member longitudinal axes substantially longer than the maximum transverse dimensions of the grinding members and lengths which are smaller than the length of the chamber but sufficiently large for retaining the grinding member longitudinal axes substantially parallel to the grinding chamber axis; and (3) a sufficient exterior surface smoothness, a cross-sectional shape and transverse dimensions which represent a small fraction of the transverse dimension of the chamber, for causing said members to cooperate in forming a tumbling mass of such members adjacent the up-running side of the chamber when it rotates and causing the mass of grinding members to migrate and move rotationally through the mass and about their own axes while said axes are held substantially parallel to the grinding chamber axis.

4. Apparatus according to claim 3 wherein the heavy ends of the grinding members are disposed toward the discharge end of the grinding chamber.

5. Apparatus according to claim 3 wherein the heavy ends of the grinding members are disposed toward the feed end of the grinding chamber.

6. Apparatus according to claim 1, 2, 3, 4 or 5 in which the mass per unit length of the respective grinding member or members progressively and substantially increases at successive positions along the length thereof.

7. Apparatus according to claim 6 wherein the cross-section of the respective grinding member or members is substantially uniform throughout the length thereof.

8. Apparatus according to claim 1, 2, 3, 4 or 5 in which the density of the respective grinding member or members progressively and substantially increases at successive positions along the length thereof.

9. Apparatus according to claim 8 wherein the cross-section of the respective grinding member or members is substantially uniform throughout the length thereof.

10. Apparatus according to claim 1, 2, 3, 4 or 5, the respective grinding member or members of which comprise a tube of substantially uniform mass per unit length, having first and second ends and including a hollow enclosure extending longitudinally between said ends, with a weight retained in said enclosure and held nearer one of said ends.

11. Apparatus according to claim 1, 2, 3, 4 or 5, the respective grinding member or members of which comprise a tube of substantially uniform mass per unit length, having first and second ends and including a hollow enclosure extending longitudinally between said ends, and a plurality of weights of varying mass which fill the cross-section of the enclosure, which are fixed in said enclosure and which are distributed along the length of said enclosure for progressively increasing the ratio of mass per unit length of the grinding member or members from said first end to said second end.

* * * * *